US007074228B2

(12) United States Patent
Cooper

(10) Patent No.: US 7,074,228 B2
(45) Date of Patent: Jul. 11, 2006

(54) MICROWAVE OVEN HEATED DEPILATORY WAX APPLICATOR

(76) Inventor: Theresa Cooper, 2220 Gaspar Ave., Los Angeles, CA (US) 90040

( * ) Notice: Subject to any disclaimer, the term of this patent is extended or adjusted under 35 U.S.C. 154(b) by 813 days.

(21) Appl. No.: 10/112,168

(22) Filed: Apr. 1, 2002

(65) Prior Publication Data

US 2003/0187463 A1 Oct. 2, 2003

(51) Int. Cl.
*A61B 1/00* (2006.01)
*A47L 13/32* (2006.01)

(52) U.S. Cl. ..... 606/134; 401/1

(58) Field of Classification Search ..... 606/134; 401/1, 2, 3, 183, 184, 185, 186, 208, 207, 401/132, 133; 222/146.1, 146.2, 146.3, 146.4, 222/146.5

See application file for complete search history.

(56) References Cited

U.S. PATENT DOCUMENTS

| | | | | |
|---|---|---|---|---|
| 5,175,404 | A * | 12/1992 | Andreas et al. | 219/730 |
| 5,544,787 | A * | 8/1996 | Malofsky | 222/105 |
| 5,556,468 | A * | 9/1996 | Legrain et al. | 118/202 |
| 5,718,356 | A * | 2/1998 | Nottingham et al. | 222/146.5 |
| 6,039,482 | A * | 3/2000 | Smal | 401/1 |
| 6,174,319 | B1 * | 1/2001 | Desnos | 606/133 |
| 6,273,625 | B1 * | 8/2001 | Martinez de San Vincente Oliveras | 401/1 |

OTHER PUBLICATIONS

Emjoi Ro-Microwax Mar. 31, 2001 @ http://web.archive.org/web/20010331040343/http://www.emjoi.com/productpages/hair/hairproducts/aboutrollon.htm, via the waybackmachine @ http://www.archive.org/.*

* cited by examiner

*Primary Examiner*—Cary E. O'Connor
*Assistant Examiner*—D. Austin Bonderer
(74) *Attorney, Agent, or Firm*—Matthew F. Jodziewicz

(57) ABSTRACT

A wax applicator for use with a microwave heating oven for dispensing a depilatory wax for removal of hair from skin comprising a hollow casing having an opening thereinto. An elongate reservoir for depilatory wax is disposed in the casing and is fabricated, at least partially, from a from a material having a first outer layer of a thermally insulating material that provides a barrier to the transmission of thermal energy and a second inner layer that absorbs radio frequency energies. The reservoir unit is adapted to be slidably inserted into the casing opening for retention in the casing. The reservoir also has disposed at a first end extending from the casing when the reservoir is retained therein, a dispensing mechanism for transporting depilatory wax from the reservoir to a surface for application. A thermally insulating material is disposed intermediate the casing and reservoir and at least partially surrounds the reservoir when the reservoir is retained in the casing for thermally isolating the reservoir from the casing. The unit relies an external microwave heating oven to melt the depilatory wax in the reservoir for application.

7 Claims, 2 Drawing Sheets

MICROWAVE OVEN HEATED DEPILATORY WAX APPLICATOR

BACKGROUND OF THE INVENTION

1. Field of the Invention

The present invention relates to an apparatus for heating and applying meltable products to a surface, and more particularly pertains to a handheld applicator for heating and applying a depilatory wax.

2. Description of the Prior Art

The use of an applicator to heat and apply a depilatory wax is known in the prior art. More specifically, depilatory wax applicators heretofore devised and utilized for the purpose of storing, heating and applying depilatory body wax are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,980,536 to Jamali discloses a wax container and application kit; U.S. Pat. No. 5,846,326 to Legrain et al. provides an applicator for meltable products such as a depilatory wax that includes a hand held applicator and a docking base for the applicator unit; U.S. Pat. No. 5,556,468 also to Legrain et al. provides a similar apparatus; U.S. Pat. No. 5,873,666 to Bourke et al. provides a wax applicator that also utilizes a hand held unit in conjunction with a docking base unit; U.S. Pat. No. 4,773,784 to Mann for a hot wax hair remover apparatus which includes a heating station and hand held dispensing units; and U.S. Pat. No. 3,858,985 to Fiveash for a hair removing applicator and process which discloses a hand held applicator with a heating circuit that requires a trailing electrical wire for the heating circuit.

In this respect, the depilatory wax applicator of the present invention substantially departs from the conventional concepts and designs of the prior art, and in so doing provides an apparatus primarily developed for the purpose of providing an applicator for maintaining meltable products such as a depilatory wax without having recourse to electrical heating elements either in a base unit or in the applicator unit itself.

Therefore, it can be appreciated that there exists a continuing need for a new and improved depilatory wax applicator which can be used for providing a single unit hand held applicator for maintaining meltable products such as a depilatory wax that does not require a docking base unit or trailing electrical connection for a user to handle and that overcomes the limitations of the prior art as to these and other aspects of the prior art as is better described below.

Likewise, there is a continuing need for a new and improved depilatory wax applicator in a hand-holdable unit that can be self-retained without having electrical connections that could pose a safety threat to users who may wish to use the unit in an environment where water and other conductive materials abound.

In this regard, at least, the present invention substantially fulfills this need.

SUMMARY OF THE INVENTION

In view of the foregoing disadvantages inherent in the known types of depilatory wax applicators now present in the prior art, the present invention provides an improved depilatory wax applicator that is capable of maintaining meltable products, in particular depilatory wax, for use in a single hand held unit applicator without having electrical connections or heating elements in the unit. As such, the general purpose of the present invention, which will be described subsequently in greater detail, is to provide a new and improved depilatory wax applicator which has all the advantages of the prior art and none of the disadvantages.

To attain this, the present invention is found in one embodiment in an applicator for heating and applying a depilatory wax that essentially comprises a hollow casing having an opening. A mating reservoir is made, at least in part, of a thermally insulating material that provides a barrier to the transmission of thermal energy but not to radio frequency energies. The reservoir is adapted to be slidably inserted into the casing opening for retention in the casing. The reservoir has disposed at a first end extending from the casing when the reservoir is retained therein, a mechanism for transporting depilatory wax from the reservoir to a surface for application. The casing is fabricated from a material capable of being safely placed in a microwave heating oven.

Another embodiment of the present invention include a hollow casing with a reservoir disposed in the casing for holding the depilatory wax. The reservoir is fabricated of a thermally insulating material that provides a barrier to the transmission of thermal energy but not to radio frequency energies so that the applicator can be heated in a microwave heating oven.

Additionally, the invention is also found in an applicator as described immediately above where the reservoir is fabricated from a material having a first outer layer of a thermally insulating material that provides a barrier to the transmission of thermal energy and a second inner layer that absorbs radio frequency energies.

There has thus been defined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wax depilator and applicator which has all the advantages of the prior art wax depilators and none of the disadvantages.

It is another object of the present invention to provide a new and improved wax depilator and applicator which may be easily and efficiently manufactured and marketed.

It is a further object of the present invention to provide a new and improved wax depilator and applicator which is of a durable and reliable construction.

An even further object of the present invention to provide a new and improved wax depilator and applicator whose design and structure are simplified, while safety in usage is increased, by eliminating internal electrical heating elements in the applicator.

Still yet another object of the present invention to provide a new and improved wax depilator and applicator whose use is facilitated when being loaded with meltable products, such as depilatory wax, and during disassembly and cleaning.

Still another object of the present invention to provide a new and improved wax depilator and applicator which is easily stored when not in use or when waiting for the product to reach operating temperature for melting the depilatory wax.

Lastly, it is an object of the present invention to provide a new and improved wax depilator and applicator which is safe for personal, home and professional use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is an illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
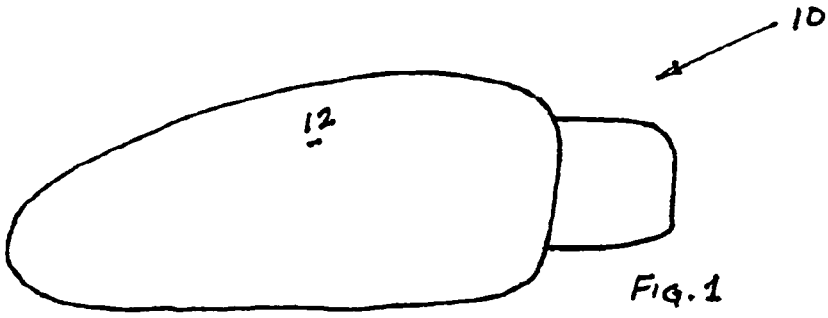
FIG. 1 is a side view of a wax depilatory applicator embodying the present invention.

With reference now being made to structure appearing in the drawings, a new and improved depilatory wax applicator for use with a microwave heating oven for dispensing a depilatory wax for removal of hair from skin that embodies the principles and concepts of the present invention and generally designated by the reference numeral 10 will be described.

Wax applicator 10 generally comprises a hollow casing 12 that is preferably adapted to be held in a user's hand for use of use. The contour and shape of casing 12 should be selected to provide applicator 10 with a small footprint to conserve space as wax applicators are used in what are normally crowded working conditions and countertop space is at a premium. Likewise casing 12 should be contoured to easily fit a user's hand for convenience during use.

A reservoir 14 is disposed in the interior of casing 12 for holding the depilatory wax that is to be heated and applied. Reservoir 14, as illustrated in the FIGS., includes a wax holding portion 16 and a neck portion 18 having an opening 20 therein through which the depilatory wax can flow from wax holding portion 16 to the dispenser described below. Reservoir 14 is preferably of a thermally insulating material 22 that provides a barrier to the transmission of thermal energy but not to radio frequency energies such as those provided by microwave heating ovens.

A dispenser head 24 communicates with opening 20 in neck 18 to permit the wax to flow from the wax holding area 16 through opening 20 in neck 18 for application to a desired surface.

As the depilatory wax must be maintained in a heated state for application, it is also preferred that reservoir 14 be thermally isolated from casing 12 to retain heat within reservoir 14 so that the depilatory wax may remain in its melted and flowable state for a longer period of time than otherwise.

One preferred method of thermally isolating reservoir 14 from casing 12 is to form an air gap 26 intermediate casing 12 and reservoir 14 and at least partially surrounding reservoir 14 when reservoir 14 is retained in casing 12.

Another method would be to at least partially fill air gap 26 with a thermally insulating material (not illustrated in the FIGS.) intermediate casing 12 and reservoir 14 that at least partially surrounds reservoir 14 when reservoir 14 is retained in casing 12.

Figure 2:
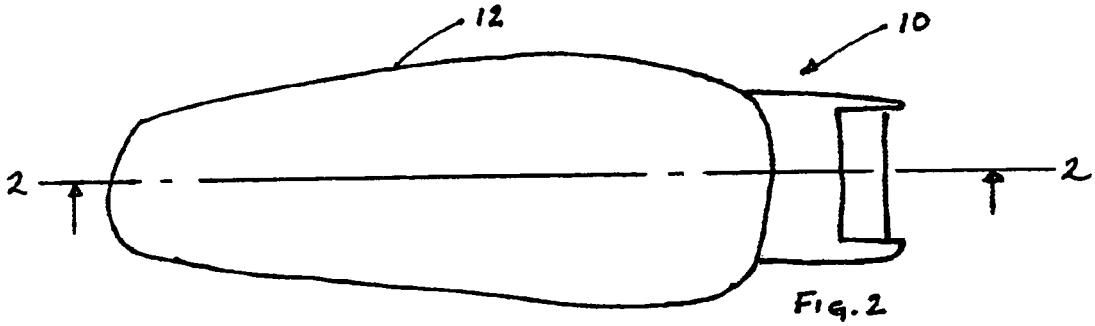
FIG. 2 is a top plan view of the apparatus illustrated in FIG. 1.
Figure 3:
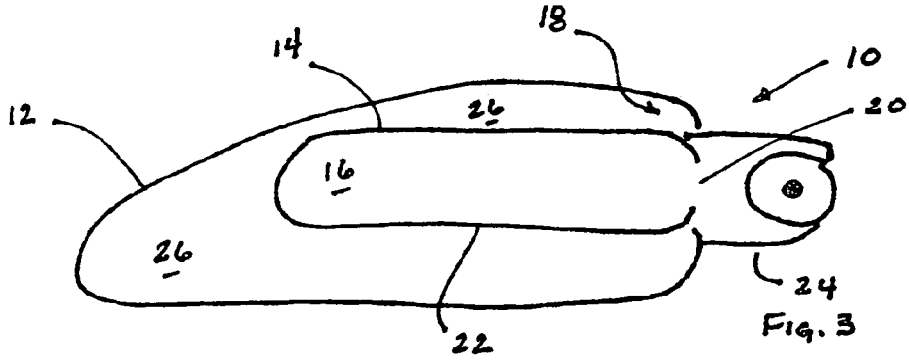
FIG. 3 is a side cross-sectional view taken along the line 2—2 of FIG. 2.
Figure 4:
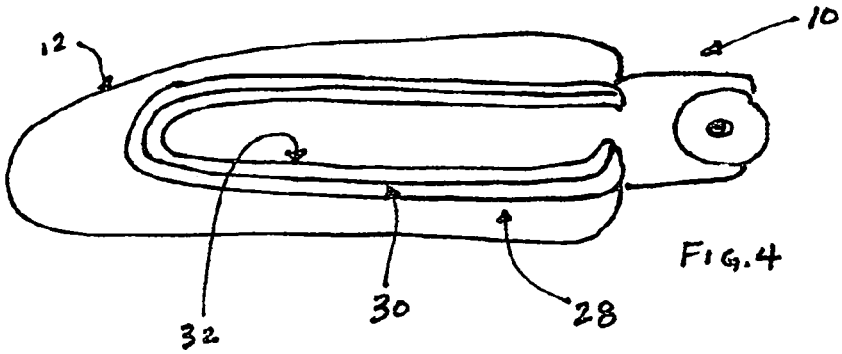
FIG. 4 is a side cross-sectional view similar to that taken along the line 2—2 of FIG. 2 of an alternate embodiment of the present invention; and, FIG. 5 is a side cross-sectional view similar to that taken along the line 2—2 of FIG. 2 of an alternate embodiment of the present invention where the reservoir member of the invention is separable from the housing or casing member of the invention.

An alternate embodiment of the present invention shown in FIG. 4 is similar to that described above in FIGS. 1 to 3, but has reservoir 28, disposed in casing 12, fabricated from a material having a first outer layer 30 of a thermally insulating material that provides a barrier to the transmission of thermal energy from the wax holding interior portion 16 of reservoir 28 to the outside environment, and a second inner layer 32 that absorbs radio frequency energies as from a microwave heating oven.

Figure 5:
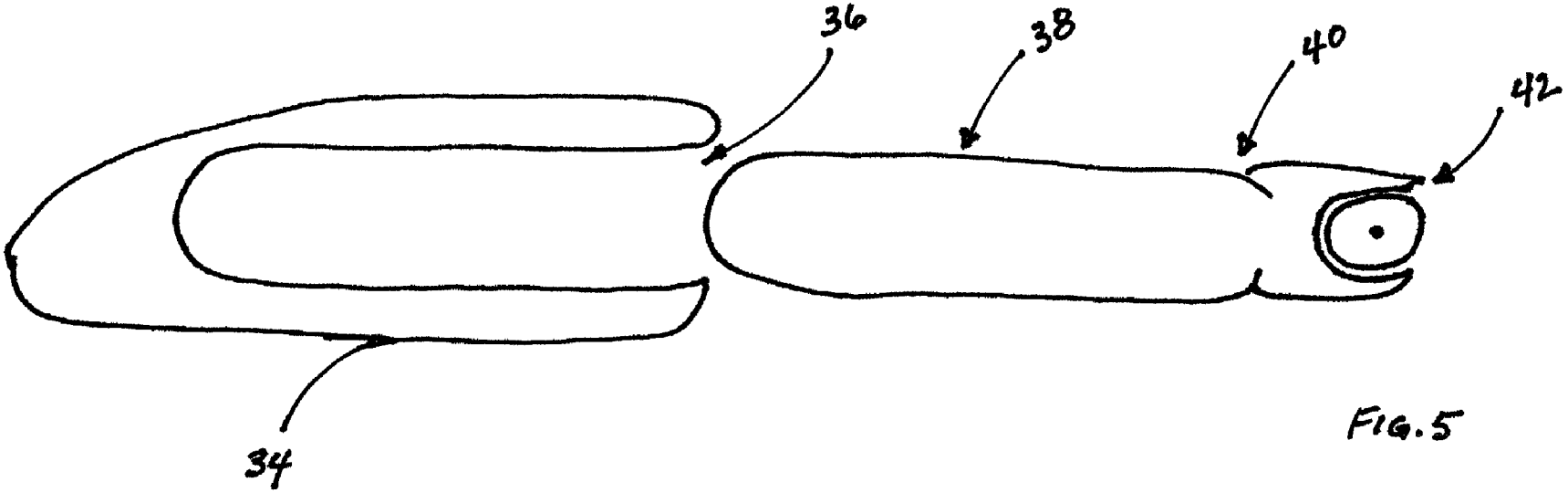

Still another alternate embodiment of the present invention in a wax applicator for use with a microwave heating oven for dispensing a depilatory wax for removal of hair from skin is shown in FIG. 5 and comprises a hollow casing 34 similar to that described above in FIGS. 1 to 4 that has an opening 36 thereinto.

In this embodiment, elongate reservoir 38 holds depilatory wax and is made at least partially of a thermally insulating material that provides a barrier to the transmission of thermal energy but not to radio frequency energies as described above as either a single or multiple layer material. Reservoir 38 is adapted to be slidably inserted into casing opening 36 for retention in casing 34. Reservoir 38 has disposed at an end 40 extending from casing 34 when reservoir 38 is retained therein, a dispenser mechanism 42 for transporting depilatory wax from reservoir 38 to a surface for application.

A preferred method embodying the invention is found in the following steps.

The depilatory wax applicator is prepared with depilatory wax being placed into the reservoir. This could be either by inserting a reservoir-dispersing mechanism cartridge assembly into the casing body as described above, or by using a casing having a fully loaded reservoir already in place in the casing, as in a one use type unit that is discarded after a single usage.

The depilatory wax is heated to the desired melting point either in the reservoir-dispensing mechanism assembly separately or with the reservoir-dispensing mechanism assembly retained in the applicator by placing the depilatory wax in a microwave heating oven.

Once the depilatory wax is heated in the reservoir, it can be applied by the user as desired to the selected surface to be depilated.

One advantage of this method and invention is that no electrical connections are needed directly with the depilatory wax applicator unit itself, so that there is no safety issues being raised with electricity being used in a situation where water may also be present, or with faulty wiring in the applicator unit itself as well. By using an external microwave heating oven to melt the wax, general safety is improved for the user of the applicator.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A wax applicator for use with a microwave heating oven for dispensing a depilatory wax for removal of hair from skin comprising:

a hollow casing fabricated from a microwave permeable material;

a reservoir means disposed in said casing for holding the depilatory wax, said reservoir means including a neck having an opening therein through which the depilatory wax can flow, said reservoir means fabricated of a thermally insulating material that provides a barrier to the transmission of thermal energy but not to radio frequency energies, said reservoir being thermally isolated from said casing by having an air gap formed intermediate said casing and said reservoir and at least partially surrounding said reservoir when said reservoir is retained in said casing; and, a dispenser head communicating with said opening in said neck to permit the wax to flow through said opening in said neck for application to a desired surface.

2. A wax applicator as in claim 1 wherein said casing is shaped to be held in a user's hand.

3. A wax applicator for use with a microwave heating oven for dispensing a depilatory wax for removal of hair from skin comprising:

a hollow casing fabricated from a microwave permeable material;

a reservoir means disposed in said casing for holding the depilatory wax, said reservoir means including a neck having an opening therein through which the depilatory wax can flow, said reservoir being thermally isolated from said casing by having an air gap formed intermediate said casing and said reservoir and at least partially surrounding said reservoir when said reservoir is retained in said casing;

a dispenser head communicating with said opening in said neck to permit the wax to flow through said opening in said neck for application to a desired surface; and, thermal insulating means at least partially surrounding said reservoir for providing a barrier to the transmission of thermal energy from said reservoir but not providing a barrier to radio frequency energies.

4. A wax applicator as in claim 3 wherein said casing is shaped to be held in a user's hand.

5. A wax applicator for use with a microwave heating oven for dispensing a depilatory wax for removal of hair from skin comprising:

a hollow casing fabricated from a microwave permeable material;

a reservoir means disposed in said casing for holding the depilatory wax, said reservoir means including a neck having an opening therein through which the depilatory wax can flow, said reservoir means fabricated from a material having a first outer layer of a thermally insulating material that provides a barrier to the trasmission of thermal energy and a second inner layer that absorbs radio frequency energies, said reservoir being thermally isolated from said casing by having an air gap formed intermediate said casing and said reservoir and at least partially surrounding said reservoir when said reservoir is retained in said casing; and, a dispenser head communicating with said opening in said neck to permit the wax to flow through said opening in said neck for application to a desired surface.

6. A wax applicator as in claim 5 wherein said casing is shaped to be held in a user's hand.

7. A wax applicator for use with a microwave heating oven for dispensing a depilatory wax for removal of hair from skin comprising:

a hollow casing having an opening thereinto and fabricated from a microwave permeable material; and, an elongate reservoir for depilatory wax being made at least partially of a thermally insulating material that provides a barrier to the transmission of thermal energy but not to radio frequency energies and adapted to be slidably inserted into said casing opening for retention in said casing, said reservoir being thermally isolated from said casing by having an air gap formed intermediate said casing and said reservoir and at least partially surrounding said reservoir when said reservoir is retained in said casing, said reservoir further having disposed at a first end extending from said casing when said reservoir is retained therein, means for transporting depilatory wax from said reservoir to a surface for application.

* * * * *